United States Patent [19]

Braverman et al.

[11] 4,316,541

[45] Feb. 23, 1982

[54] MOISTURE IMPERVIOUS COVER SHEET FOR UNIT DOSE PACKAGING

[75] Inventors: Milton Braverman; Leonard Zink, both of Philadelphia, Pa

[73] Assignee: Medi-Dose, Inc., Feasterville, Pa.

[21] Appl. No.: 135,562

[22] Filed: Mar. 31, 1980

[51] Int. Cl.[3] ..... B65D 83/04; B65D 75/42; B65D 85/56; B65D 75/32

[52] U.S. Cl. ..... 206/532; 206/633; 206/820; 229/43

[58] Field of Search ..... 206/532, 633, 820; 229/43, 3.1, 7

[56] References Cited

U.S. PATENT DOCUMENTS

| | | | |
|---|---|---|---|
| 2,197,739 | 4/1940 | Bensel | 229/7 R |
| 2,630,262 | 3/1953 | Bergstein | 229/3.1 |
| 3,305,077 | 2/1967 | Greif et al. | 206/232 |
| 3,503,493 | 3/1970 | Nagy | 206/232 |
| 3,715,073 | 2/1973 | Gibbs et al. | 229/43 |
| 3,809,221 | 5/1974 | Compere | 206/633 |
| 3,894,896 | 7/1975 | Watanabe | 156/69 |
| 3,899,080 | 8/1975 | Brunda | 206/531 |
| 3,921,805 | 11/1975 | Compere | 206/532 |
| 3,924,746 | 12/1975 | Haines | 206/530 |
| 3,924,748 | 12/1975 | Braverman | 206/534.1 |
| 4,055,672 | 10/1977 | Hirsch et al. | 426/127 |
| 4,169,531 | 10/1979 | Wood | 206/531 |

*Primary Examiner*—William T. Dixson, Jr.
*Attorney, Agent, or Firm*—Caesar, Rivise, Bernstein & Cohen

[57] ABSTRACT

A barrier sheet for securement to the cover sheet of a multi-compartment medicinal dispensing device to render the cover sheet impervious to moisture. The device also includes a base to which the cover sheet is secured. The cover sheet includes plural closures releasably secured to one another along weakened lines. The barrier sheet is formed of a moisture impervious plastic and has a central portion, a top edge portion, a bottom edge portion and an opposed pair of side edge portions. The central portion and the edge portions each include an adhesive underside surface. The central portion includes plural weakened lines corresponding to the weakened lines in the closures of the device. Each of the edge portions of the barrier sheet is in the form of an elongated foldable flap. The barrier sheet is secured to the cover sheet by disposing it on the cover sheet with the weakened lines of the barrier sheet coincident with the weakened lines of the cover sheet and with the adhesive on the underside of the barrier sheet in contact with the cover sheet. The flaps are folded around the edges of the cover sheet and into securement with the device base to seal the edges of the cover sheet.

15 Claims, 9 Drawing Figures

MOISTURE IMPERVIOUS COVER SHEET FOR UNIT DOSE PACKAGING

This invention relates generally to multi-compartment medicinal dispensing devices and more particularly to means for rendering multi-compartment medicinal dispensing devices impervious to water or moisture.

Various multi-compartment medicinal dispensing devices are commercially available for providing multiple unit doses of medication. For example, in U.S. Pat. No. 3,780,856, whose disclosure is incorporated by reference herein, there is disclosed and claimed a multi-compartment medicinal dispensing device which is arranged for holding plural doses of medicine therein for subsequent dispensation. The device is arranged to be simply loaded and labeled by hospital or other personnel.

Unlike prior art devices, the device of said patent is arranged for manual unit dose use. To that end, that dispensing device comprises a base and a cover sheet. The base comprises a plurality of individual medicine holding units, each having flanges thereon. The flanges have corners and are detachably connected along predetermined weakened lines so that the flange of one unit can be separated from the flange of an adjacent unit to separate the units from one another. Each unit also includes a chamber with an outer opening depending from the flanges forming the unit. The chamber is adapted to hold the drug, tablet, capsule or the like therein. The base is formed of plastic or any other suitable material. A cover sheet, formed of paper, cardboard and the like is arranged to seal the medicines within the individual units. The cover sheet has a removable liner sheet releasably secured thereto. The cover sheet includes an underside surface having an adhesive thereon and is perforated along predetermined lines corresponding to the flange lines to form a plurality of individual closures therebetween. Each of the closures corresponds to an individual unit of the base and is arranged to seal the opening of the chamber in the unit which is disposed thereunder. Areas of the cover sheet which are disposed immediately over the chamber openings of the base are non-tacky. At least one corner of the flange of each unit is cut away so that the existing corner of the individual closure overlying the cut away area functions as a lift tab to facilitate the separation of the closure from the flange to which it is connected, to thereby provide access to the contents of the chamber disposed thereunder.

In one embodiment of the invention disclosed in said patent, the article holding units are provided in an array of five rows of five columns, i.e., five units per row.

As mentioned above, the cover sheet is formed of paper or other suitable material and includes a top surface which is suitable for carrying indicia thereon, e.g., information about the prescription, etc.

While the medicinal dispensing device of the aforenoted patent is suitable for its intended purposes, it may not provide sufficient protection for moisture sensitive drugs stored in humid or wet conditions for an extended period of time.

Accordingly, it is the general object of the instant invention to provide means for rendering prior art multi-compartment medicinal dispensing devices, like that disclosed and claimed in the aforenoted patent, impervious to moisture.

It is a further object of the instant invention to provide a barrier sheet which is simple in construction and low in cost and which can be used to seal the cover sheet of a multi-compartment medicinal dispensing device against the ingress of moisture.

It is still a further object of the instant invention to provide a moisure impervious barrier sheet for use with multi-compartment medicinal dispensing devices and which does not impede the separation of individual compartments from one another.

It is still a further object of the instant invention to provide a moisture impervious barrier sheet for multi-compartment medicinal dispensing devices which can be readily secured to such devices.

These and other objects of the instant invention are achieved by providing a moisture impervious barrier sheet for use on a multi-compartment medicinal dispensing device having a base to which a cover sheet is secured, with said cover sheet including plural closures releasably secured to one another along weakened lines. The barrier sheet is formed of a moisture impervious plastic and comprises a central portion, a top edge portion, a bottom edge portion and an opposed pair of side edge portions. Each of the the portions includes an inner surface having an adhesive thereon. Each of said edge portions is in the form of a elongated foldable flap. The central portion corresponds in size with the cover sheet of the medicinal dispensing device and includes weakened lines corresponding to the weakened lines of the cover sheet. The barrier sheet is securable to the cover sheet by disposing it on the cover sheet so that its adhesive contacts the cover sheet with its weakened lines coincident with the weakened lines of the cover sheet and with its flaps folded around the edges of the cover sheet and into securement with the multi-compartment base.

Other objects and many of the attendant advantages of this invention will become readily apparent by reference to the accompanying drawing wherein:

FIG. 1 is a planar view of a multi-compartment medicinal dispensing device, like that shown and claimed in U.S. Pat. No. 3,780,856 and to which a moisture impervious barrier sheet of the instant invention is secured;

Figure 2:
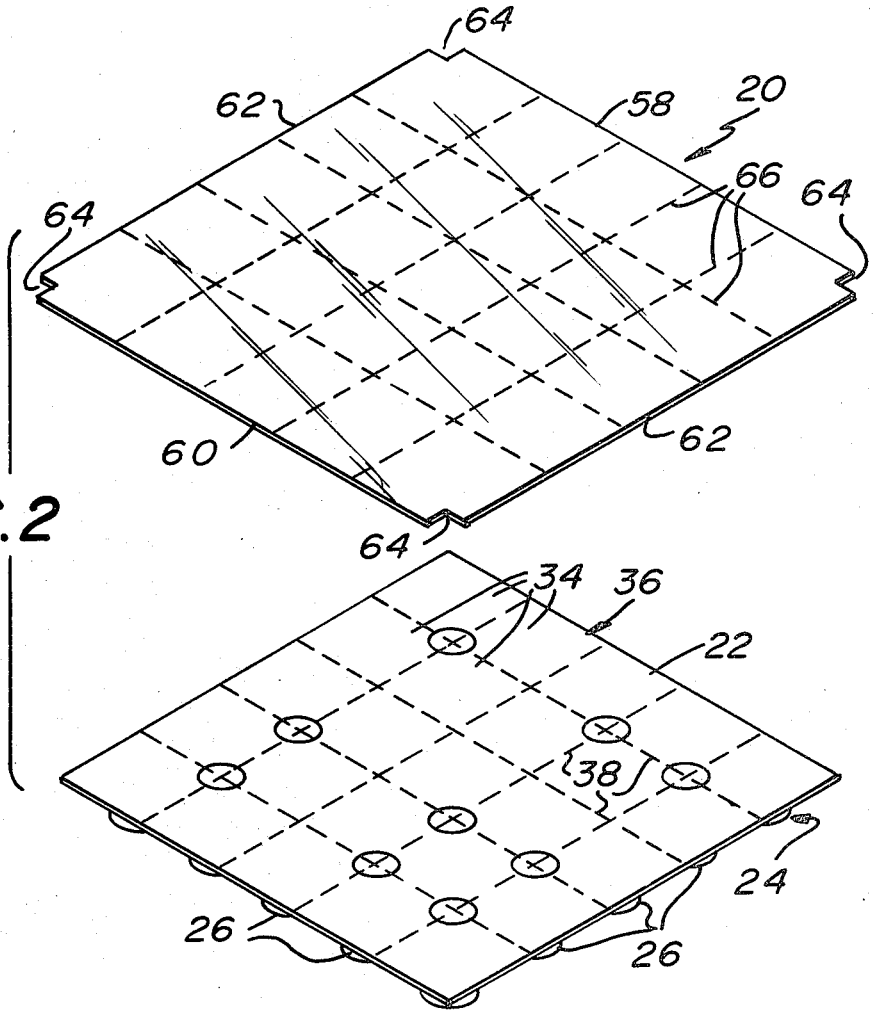
FIG. 2 is an exploded perspective view of the moisture impervious barrier sheet of the instant invention shown disposed over a medicinal dispensing device prior to securement thereto.

Referring now in greater detail to the various figures of the drawing wherein like reference characters refer to like parts, there is shown at 20 in FIG. 2 a moisture impervious barrier sheet for securement to a multi-compartment medicinal dispensing device 22, like that disclosed and claimed in the aforenoted U.S. Pat. No. 3,780,856.

Figure 1:
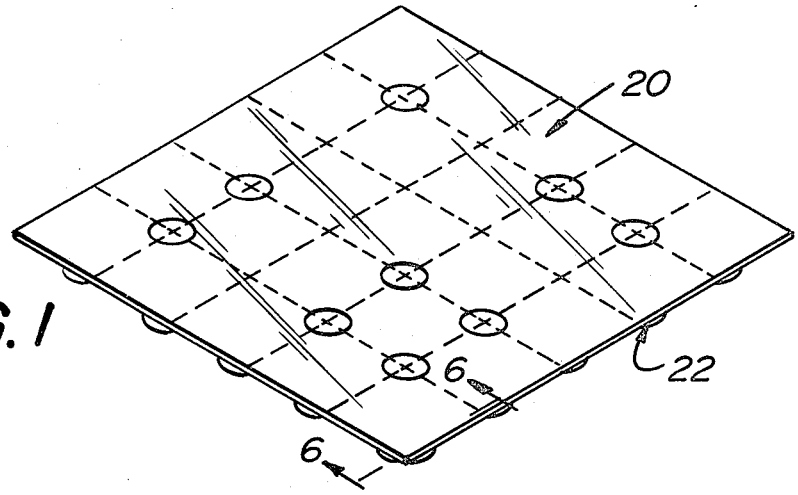

Before describing the details of the barrier sheet, a brief review of the construction of the dispensing device 22 is in order. To that end, the device 22 includes a multi-compartment base number 24 (FIGS. 1 and 6) for holding a plurality of doses of medicine (not shown) therein. The base 24 includes a plurality of article holding units 26, each of which is of generally rectangular shape and comprises four flanges 28 having corners and a chamber 30 depending from the flanges. The chamber is bowl shaped and includes an opening (not shown) through which the medicine is inserted for disposition within the chamber. The units 26 are detachably connected together by their flanges along intersecting weakened or perforated lines 32. Each unit has one flange having a cut-away corner (not shown).

Figure 6:
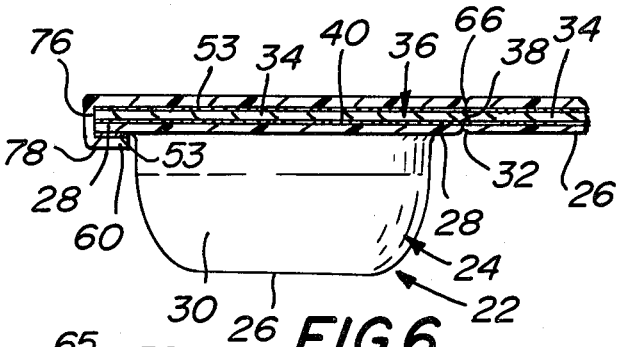
FIG. 6 is an enlarged sectional view taken along line 6—6 of FIG. 1.

The contents in the chamber of each unit is sealed therein by a respective closure 34 (FIGS. 2 and 6). Each closure 34 is a portion of a cover sheet 36. The cover sheet 36 is preferably formed of a strong and sturdy paper base. Preferably, the exterior surface of the cover sheet is coated to be receptive to pencil, ink, multilith spirit masters and photocopy offset so that writing or other indicia can be placed upon the exterior surface of the closures. The cover sheet is perforated along intersecting lines 38 which correspond to the flange lines 32 of the base 24. The intersecting lines 38 define five rows of five columns of closures 34 therebetween, with each closure being co-extensive in size within an associated article holding unit 26.

The cover sheet 36 includes an adhesive layer 40 on its underside for securement to the flanges 28 of the base 24. When the cover sheet 36 is secured in place, its perforated lines 38 overly and are co-linear with the flange lines 32 so that each closure member 34 is secured in place to an associated unit 26 to seal the opening of the chamber in the unit. The coincident perforated lines 38 and flange lines 32 enable each unit 26 to be detached from the others to provide individual, sealed, doses of medicine.

When it is desired to remove the contents of any unit 26, the closure 34 sealing that unit is peeled off at the cut away flange corner to provide access to the interior of the chamber and to the medicine disposed therein.

The moisture impervious barrier sheet 20 in the instant invention is arranged for securement to the device 22 or similarly constructed devices to prevent moisture from gaining ingress to the interior of the chambers 30 via the closures 34 or the adhesive interface 40 between the closures and the base 24.

Figure 3:
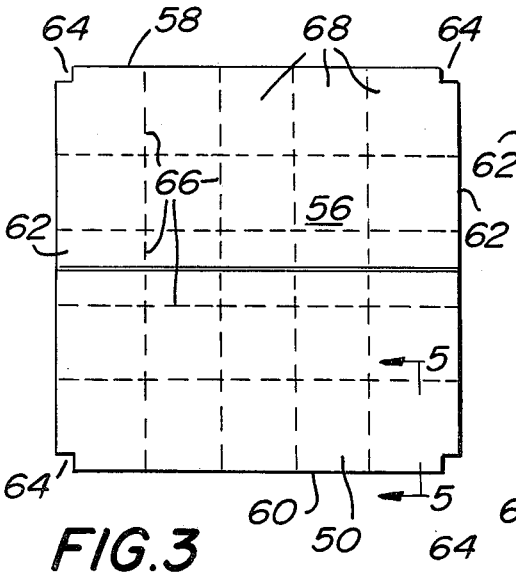
FIG. 3 is a reduced plan view of the top surface of the barrier sheet of the instant invention.
Figure 4:
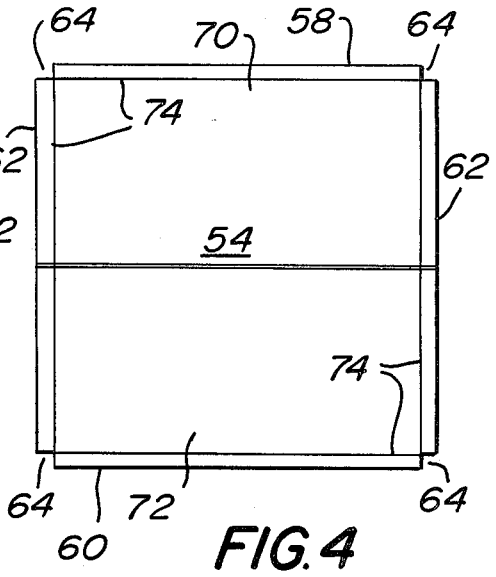
FIG. 4 is a reduced plan view of the underside surface of the barrier sheet.
Figure 5:
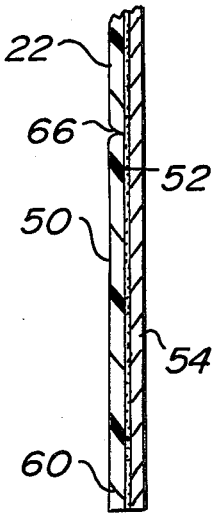
FIG. 5 is an enlarged sectional view taken along line 5—5 of FIG. 3.

Referring now to FIGS. 3, 4 and 5, it can be seen that one embodiment of the barrier sheet 20 basically comprises a planar sheet of a moisture impervious, preferably plastic material, e.g., polyethylene terephthalate which is a polymeric plastic sold under the brand name Mylar, having an outer surface 50 and an inner surface 52. An adhesive layer 53 is disposed on the inner surface 52. A relatively non-sticky, e.g., glassine, liner sheet 54 is releasably secured to the adhesive layer 53 of the barrier sheet 20. The liner sheet 54 is of corresponding size and shape to the barrier sheet 20 and serves to protect the adhesive thereon until the barrier sheet is ready for securement to a multi-compartment medicinal dispensing device 22.

Figure 7:
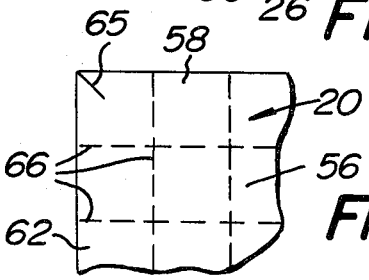
FIG. 7 is a partial plan view of the top surface of an alternative embodiment of the barrier sheet of the instant invention.

Referring now to FIGS. 2, 3 and 4, it can be seen that the barrier sheet 20 is of generally square shape having a central portion 56, a top edge portion 58, a bottom edge portion 60 and an opposed pair of side edge portions 62. Each of the edge portions is in the form of an elongated foldable flap. The foldable flaps are formed in the embodiment of FIGS. 1–6 by notches in the corners at which the edges meet. To that end, a right angle notch 64 is located at the intersection of top edge 54 and side edge 62. A similar notch 64 is located at the intersection of top edge 58 and the other side edge 62. A similar notch 64 is located at the intersection of the bottom edge 60 and one side edge 62 and a similar notch 64 is located at the intersection of the bottom edge 60 and the other side edge 62. The depth of the notches 64 is such that the width and height of the central portion 56 formed between adjacent notches is equal to the width and height, respectively, of the multi-compartment medicinal dispensing device to which it is to be secured. In the embodiment of FIG. 7, the flaps are formed by diagonally extending slits 65 whose length is such that the central portion 56 is also equal to the width and height of the dispensing device.

A plurality of weakened lines 66 are provided in the barrier sheet. The weakened lines 66 are formed by a series of tightly packed perforations extending through the thickness of the barrier sheet 22 (See FIG. 5). The perforated lines 66 are disposed in two groups. One group of perforations extends from the top edge 58 to the bottom edge 60 and another group of perforations 66 extends from one side edge 62 to the other edge 62 so that the perforated lines intersect one another at right angles. The intersecting perforated lines form a plurality of barrier sections 68. The size and shape of the barrier sections corresponds to the size and shape of the closures 34 of the cover sheet of the multi-compartment medicinal dispensing device 22.

In FIG. 4 there is shown the underside of the barrier sheet 20 embodiments of FIGS. 1–6. As can be seen therein, the liner sheet 54 is composed of two sections, namely, upper section 70 and lower section 72.

As can be seen in FIG. 4, the upper section 70 of the liner sheet includes indicia or lines 74 thereon. The lines 74 define the perimeter of the central portion 56 of the barrier sheet and define the location at which the multi-compartment medicinal dispensing device 22 is to be secured to the barrier sheet. The lines 74 also define fold lines for the foldable edges 58, 60 and 62.

It must be noted at this juncture that while only the upper section 70 is shown as including lines 74, the lower section 72 may also include such lines if desired. Moreover, the liner sheet of the embodiment shown in FIG. 7 is constructed similarly to the embodiment of FIGS. 1–6 and includes lines 74 thereon.

The securement of the barrier sheet 20 to an assembled multi-compartment medicinal dispensing device 22 is as follows:

The lower section 72 of the barrier sheet lining 54 is removed from the barrier sheet to expose the adhesive 52 on the underside of the barrier sheet. The barrier sheet is then placed on a suitable support with the adhesive side up and an assembled multi-compartment medicinal dispensing device 22 is placed face down against the exposed adhesive of the barrier sheet and within the boundary defined by the lines 74. Pressure is lightly applied to the base 24 of the device 22 to force its cover sheet 36 into engagement with the exposed adhesive 52 on the cover sheet. This secures one half of the barrier sheet to the device's cover sheet. The device 22 with the partially secured barrier sheet is then turned over and the upper section 70 of the liner sheet 54 is removed to expose the adhesive on the upper portion of the barrier sheet. The barrier sheet is then pressed into place to secure it over the entire upper surface of the liner sheet 36. In order to seal the peripheral edges 76 (FIG. 6) of the cover sheet and the interface between the flanges 28 and the cover sheet contiguous with the edges 76, the foldable flaps 58, 60 and 62 are folded around the peripheral edge of the device 22 and into engagement with the underside surface 78 of the peripheral flange 28 of the device's base member 24.

When the barrier sheet 20 is secured to the device as described immediately above, its intersecting weakened or perforated lines 66 coincide with the weakened lines 38 and 32 of the device 22. This feature enables the individual units 26 to be readily separated from one another so that the device 22 maintains its full functional capabilities.

Figure 8:
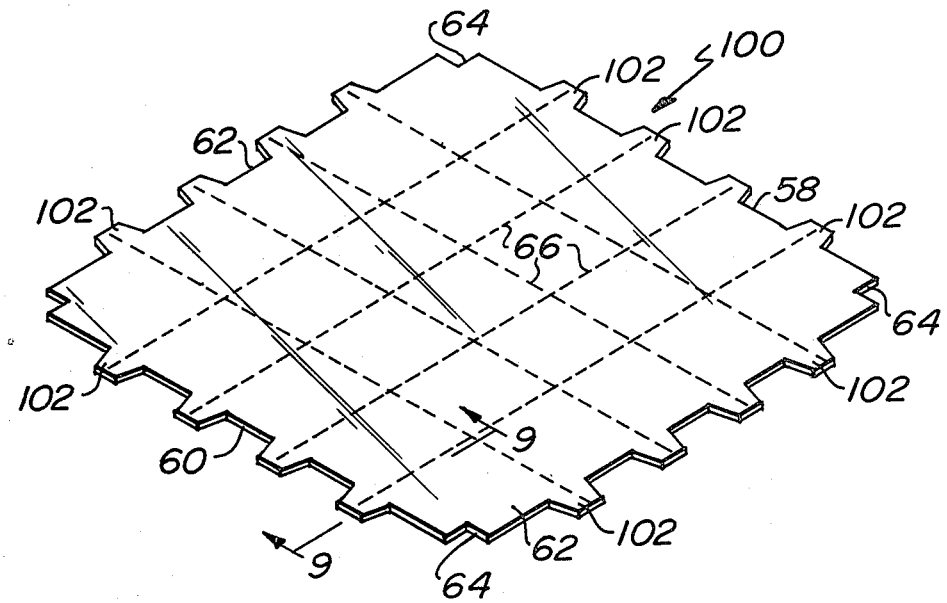
FIG. 8 is a perspective view of yet another alternative embodiment of the instant invention.

Referring now to FIG. 8, another embodiment of the barrier sheet of this invention is shown generally by the reference numeral 100. The barrier sheet 100 is arranged to provide a greater degree of securement of the barrier sheet flap to the base of the multi-compartment dispensing device 22 than the embodiments 20 shown and described with reference to FIGS. 1–7.

The barrier sheet 100 is constructed in an identical manner to the barrier sheet 20 except for the addition of plural projecting tabs 102. The tabs 102 project outward from the edge of the flaps 58, 60 and 62. Each tab 102 is located on its associated flap at the location of the perforated or weakened lines 66 and such lines extend to the free edge of the tab. Each tab is of a generally truncated triangular shape, with the maximum width being slightly less than the spacing between immediately adjacent chambers 26 of the base of the device 22. The underside 52 of the entire barrier sheet 100 includes the heretofore described alhesive layer 53. A liner sheet 54, which corresponds in shape to the barrier sheet, is releasably secured to the adhesive layer as described with reference to barrier sheet 20.

Figure 9:
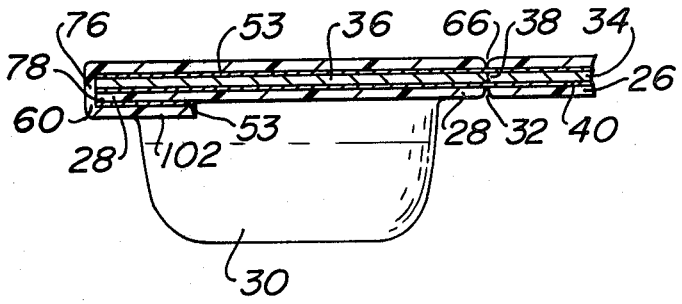
FIG. 9, is an enlarged sectional view similar to that of FIG. 6 taken along the position of line 9—9 of FIG. 8, but after the embodiment shown in FIG. 8 has been secured to a medicinal dispensing device.

The tabs 102 provide additional securement to the base 24 of the multi-compartment device 22 beyond that which is provided by the somewhat narrow flaps 58, 60 and 62 of the barrier sheet 20. To that end, as can be seen by comparing FIGS. 6 and 9, when the flaps 58, 60 and 62 are bent around the peripheral edge of the device 22 and into engagement with the underside surface 78, each of the tabs 102 extends beyond the peripheral flange of the device 22 and into the space between adjacent chambers and into engagement with the base flange portion thereat. Such action provides additional adhesive holding power for the flap.

Like the barrier sheet 20, the barrier sheet 100 may include notches 64 in its corner, angularly extending slits 65 or any other means enabling the contiguous flaps to be bent independently of each other into engagement with the base of the device 22.

As should be appreciated from the foregoing, the barrier sheet of the instant invention is simple in construction, is relatively low in cost and provides a viable means for sealing multi-compartment medicinal dispensing devices or other unit dose packaging from the ravages of moisture and without impairing the ability of such devices to provide unit doses as needed by the ready separation of individual medicine holding compartments from each other.

Without further elaboration, the foregoing will so fully illustrate our invention that others may, by applying current or future knowledge, readily adapt the same for use under various conditions of service.

What is claimed as the invention is:

1. A moisture impervious barrier sheet for use on a multi-compartment medicinal dispensing device having a base, said base including a plurality of medicine-holding chambers releasably secured to each other along weakened lines and to which a cover sheet is secured, said cover sheet including plural closures, one for each of said chambers and releasably secured to one another along weakened lines corresponding to the weakened lines of said base, said barrier comprising a sheet formed of a moisture impervious material and having a central portion, a top edge portion, a bottom edge portion and an opposed pair of side edge portions, said central portion and edge portions each including an inner surface having an adhesive thereon, each of said edge portions being in the form of an elongated foldable flap, said central portion corresponding in size with the cover sheet of said dispensing device and including weakened lines corresponding to the weakened lines of the cover sheet, said barrier sheet being securable to said cover sheet by disposing the barrier sheet on the cover sheet so that said adhesive contacts the cover sheet permanently securing the barrier sheet to the cover sheet and with the weakened lines of the barrier sheet being coincident with the weakened lines of the cover sheet and with said flaps being folded around the edges of said cover sheet and into engagement with said base to render the cover sheet and the interface between it and said base impervious to the ingress of moisture into said device.

2. The barrier sheet of claim 1 wherein said moisture impervious material comprises a plastic.

3. The barrier sheet of claim 2 additionally comprising a liner sheet releasably secured to the plastic barrier sheet by the adhesive on the underside of the barrier sheet.

4. The barrier sheet of claim 3 wherein said weakened lines are perforated.

5. The barrier sheet of claim 4 wherein said top edge meets each of said side edges in a respective notched corner and wherein said bottom edge meets each of said side edges in a respective notched corner.

6. The barrier sheet of claim 5 wherein said weakened lines intersect one another to form an array of five rows of five columns of sections, each section corresponding in size to a respective closure of the cover sheet of said device.

7. The barrier sheet of claim 6 wherein said liner sheet comprises two separable sections.

8. The barrier sheet of claim 7 wherein said plastic comprises polyethylene terephthalate.

9. The barrier sheets of claim 4 wherein said top edge meets each of said side edges in a respective slit corner and wherein said bottom edge meets each of the side edges in a respective slit corner.

10. The barrier sheet of claim 9 wherein said weakened lines intersect one another to form an array of five rows of columns of sections, each section corresponding in size to a respective closure of the cover sheet of said device.

11. The barrier sheet of claim 10 wherein said liner sheet comprises two separable sections.

12. The barrier sheet of claim 11 wherein said plastic comprises polyethylene terephthalate.

13. The barrier sheet of claim 5 additionally comprising plural tab portions projecting outward from each of said flaps for adhesive securement to portions of said base.

14. The barrier sheet of claim 13 wherein said tab portions are located contiguous with said weakened lines and said weakened lines extend to the free edge of said tab portions.

15. The barrier sheet of claim 14 wherein each of said tabs is in the shape of a truncated triangle.

* * * * *